United States Patent [19]

Tippins

[11] 4,348,882

[45] * Sep. 14, 1982

[54] HOT ROLLING STRIP

[75] Inventor: George W. Tippins, Pittsburgh, Pa.

[73] Assignee: Tippins Machinery Company, Inc., Pittsburgh, Pa.

[ * ] Notice: The portion of the term of this patent subsequent to Jan. 5, 1999, has been disclaimed.

[21] Appl. No.: 228,795

[22] Filed: Jan. 23, 1981

Related U.S. Application Data

[63] Continuation-in-part of Ser. No. 115,611, Jan. 28, 1980, Pat. No. 4,308,739.

[51] Int. Cl.[3] ..... B21B 41/02

[52] U.S. Cl. ..... 72/202; 72/229; 72/234

[58] Field of Search ..... 72/226, 227, 229, 231, 72/234, 365, 366, 202

[56] References Cited

U.S. PATENT DOCUMENTS 3,803,891 4/1974 Smith ..... 72/231

4,308,739 1/1982 Tippins ..... 72/229

FOREIGN PATENT DOCUMENTS 918005 2/1963 United Kingdom ..... 72/229

*Primary Examiner*—Francis S. Husar

*Assistant Examiner*—Jonathan L. Scherer

*Attorney, Agent, or Firm*—Webb, Burden, Robinson & Webb

[57] ABSTRACT

The hot rolling of metal slabs to strip thickness and in coils having a specific weight on the order of 500 pounds per inch of width and greater comprises passing a heated metal slab through a roughing mill to form a transfer bar. The transfer bar is immediately passed between work rolls of a reversing finishing mill stand where it is coiled in a furnace downstream of the reversing finishing mill stand. Thereafter, the workpiece is passed back through the reversing finishing mill stand and coiled in a furnace on the upstream side thereof. The workpiece is again passed through the reversing finishing mill stand and into the remaining finishing stands where it is further reduced and ultimately coiled in strip form. The first two passes through the reversing finishing mill stand are carried out at speeds in excess of the third pass and unrelated to the speed cone of the remainder of the continuous finishing stands. The third pass through the reversing finishing mill stand is carried out at a rolling speed consonant with the speed cone on the subsequent passes through the continuous finishing stands.

9 Claims, 5 Drawing Figures

HOT ROLLING STRIP

CROSS REFERENCES TO RELATED APPLICATIONS

This application is a continuation-in-part of U.S. Pat. No. 4,308,739, issued Jan. 5, 1982, and entitled "Method For Modernizing A Hot Strip Mill". U.S. Pat. No. 4,308,739 is hereby incorporated by reference into this application and made a part hereof.

BACKGROUND OF THE INVENTION

This invention relates to the hot rolling of metal slabs to strip thicknesses in coil form having specific weights on the order of 500 pounds per inch of width or greater. In my application Ser. No. 115,611, I disclose a method of modernizing a hot strip mill by eliminating from the finishing train the second finishing stand (F2) and converting the first finishing stand (F1) into a reversing finishing mill stand. This has permitted obsolete or marginally acceptable mills to be converted so as to produce the quality of hot strip product that is in demand in the marketplace today without a large capital expenditure or prohibitive production interruption. I have found that it is not always practical to convert such obsolete or marginally acceptable mills because of factors such as mill stand spacing, motor room arrangement, facility production commitments and mechanical limitations on the existing finishing stand, F1. However, I have been able to establish that such a final arrangement is so beneficial that it remains advantageous to utilize my rolling techniques through the use of a completely new installation or further refinements of existing installations which have severe limitations which preclude the utilization of the method for modernizing a hot strip mill disclosed in my eariler application.

While hot reversing mills have been utilized heretofore for many years, no one has recognized the tremendous advantages that can be achieved through the appropriate mill arrangement and the method of rolling which I have discovered. Historically, hot mills have been operated at a level to accommodate the tail of the coil which, during processing, becomes the coldest and thus the most difficult to deform. The so-called zoom mills speed up the tail of the coil to limit heat loss. Coil boxes have also been employed. These coil boxes are static in performance and while they reduce the temperature differential from head to tail of the coil, they do it by bringing the hotter end down to the level of the colder end.

SUMMARY OF THE INVENTION

My method provides the capability to roll coils having substantial pounds per inch of width (PIW) with uniform gauge and thermal mechanical properties from end to end. The temperature differential is reduced by a process which maintains a constant higher temperature and not by maintaining a more constant lower temperature as in the coil box arrangements. I am able to roll thinner hot band products than otherwise possible with a minimum of mill stands while still maintaining a high production rate. Because of the extremely advantageous temperature conversion aspects of the subject rolling method, the mill arrangement provides the capability to roll high strength stainless steel and refractory metals. The resultant mill requires considerably less connected horsepower than conventional mills. The overall length of the mill equipment and, therefore, the building is likewise substantially less than for conventional mills. The total investment cost remains much less as compared to conventional mills and, once constructed, the manpower requirements to operate and maintain the facility are also less.

The lower resistance to deformation brought about by my rolling method reduces the required power per unit of reduction and is an effective energy conservation measure. Likewise, the resultant opportunity to lower furnace temperature and decrease the BTU per ton is also an effective energy conservation measure. Finally, the ability of the mill to accept material from the delay table upstream of the reversing mill independent of the product being rolled therethrough permits the delivery speed of the product from the finishing mills to be modulated as a function of finished gauge which thusly simplifies the strip cooling process. In other words, many of the various rolling parameters out of the finishing train are totally independent of the rolling parameters into the reversing mill, which situation is not true of the new hot mills or the antiquated hot mill.

The hot strip mill which is operated in accordance with my invention includes a reversing hot strip mill positioned ahead of and as part of the finishing train. Rolling is accomplished by passing a heated metal slab into and through a roughing mill and reducing the slab to a transfer bar on the order of one to three inches in thickness. The transfer bar immediately passes through the reversing finishing mill stand and into a downstream coiling furnace. The transfer bar which has now been further reduced and which constitutes the workpiece is passed back through the hot reversing stand into an upstream coiling furnace. The workpiece is then passed for the third time through the reversing mill and into the remainder of the finishing train. The rolling speed of the third pass through the reversing finishing mill stand is consonant with the speed cone of the remainder of the finishing stands, whereas the rolling speeds of the two preceding passes on the reversing mill stand are greater than the speed on the third pass and are unrelated to the aforesaid speed cone.

DESCRIPTION OF THE PREFERRED EMBODIMENTS

My process utilizes a reversing finishing mill stand having coiler furnaces on either side thereof upstream of the first standard finishing mill stand normally referred to as F1. The initial passes through the reversing mill are carried out independent of the speed cone of the finishing train. Only the final pass through the reversing mill initiated from the upstream side thereof is consonant with the finishing train speed cone. This permits all but the final pass through the reversing mill to be carried out at speeds in excess of the suck-in speed of F1 as dictated by the speed cone.

Figure 1:
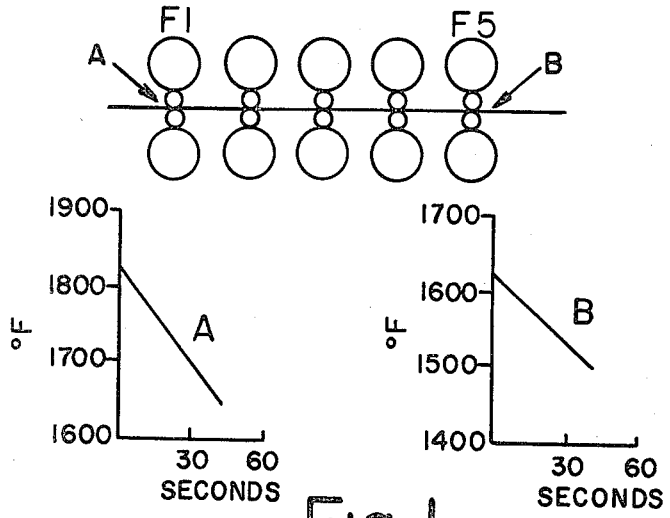
FIG. 1 is a schematic graphically showing temperature profiles for an existing rolling practice resulting in coils having 257 PIW.

FIGS. 1–4, which reflect results of a mathematical model, characterize and graphically illustrate the basic thermal advantage of my invention as compared to the hot rolling practices of an existing facility. This facility is presently in operation producing various commercial products and is equipped with a computer based data logging system which was used to verify the validity of the mathematical model of the hot rolling process. The arrangement of the five-stand hot strip mill finishing train, shown schematically in FIG. 1, is typical of many mills. The temperature rundown charts represent the head end and tail end temperature of the steel at points immediately ahead of stand F1 (shown as A) and immediately after stand F5 (shown as B). The time base represents the mill rolling time for 0.080 inch finish gauge with a specific slab weight of 257 PIW, which is the maximum capability of this existing facility. The severe temperature loss and variation in temperature from head to tail of the strip are at the limits of the market acceptance of this product and larger coils are impossible to produce.

It is particularly important to note that the temperature profile of the rolled product (FIG. 1, curve B) is quite similar to the profile of the transfer bar (FIG. 1, curve A). This characteristic requires that the rolling schedule be set by the mill operator or process computer to accommodate the tail end, or worst case condition, thereby either causing an overload condition at the tail end or necessitating an under-utilization of the five stand mill at the head end and throughout most of the strip.

Figure 2:
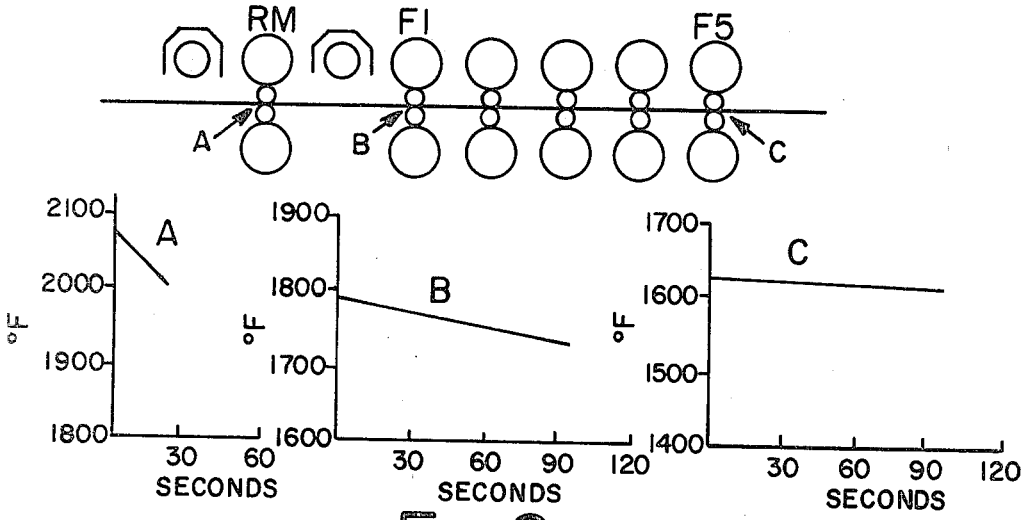
FIG. 2 is a schematic graphically showing temperature profiles of my rolling method designed to provide coils having 545 PIW.

FIG. 2 shows the same hot strip mill finishing train of FIG. 1 modified by the concept of my invention with the addition of a reversing finishing mill stand RM and the two coil furnaces upstream of F1. The computer based calculated temperature rundown charts, FIG. 2, represent the temperature of the steel at points immediately ahead of the reversing mill RM (shown as A) and F1 stand (shown as B) and immediately after F5 stand (shown as C). Because of the ability to transfer a thicker sheet bar, coupled with the ability to make the first reduction on the reversing mill independent of any speed cone, hence at a considerably higher speed than in FIG. 1, the steel arrives at the reversing mill (FIG. 2, curve A) substantially hotter and with less end to end thermal differential than originally (FIG. 1, curve A).

Three passes are taken on the reversing stand RM, reducing the strip to a thinner gauge than the transfer bar thickness used originally, and the steel is transferred to the existing five stand finishing train starting at F1. However, because of the temperature conservation characteristics of the reversing stand the temperature profile is now quite different at stand F1, shown as curve A in FIG. 1. Curve B of FIG. 2 shows that the temperature of the steel being delivered to F1 is quite uniform and the end-to-end temperature shows only approximately a 50° F. differential while the same position in FIG. 1 shows approximately a 190° F. differential. This flattening of the temperature curve provides for a better utilization of the five stand continuous mill and more effective rolling, and since the strip is approximately 100° F. hotter, it can accordingly be rolled in higher PIW coils, to thinner finished gauges.

The time base for the temperature charts in FIG. 2 at stands F1 and F5 (curves B and C, respectively) again represents the rolling time of the mill, although in this case the finish gauge is 0.059 inch with a specific slab weight of 545 PIW, which is a tremendous improvement of the mill capabilities. The magnitude of this improvement is graphically illustrated in FIG. 4 which compares the existing practice with the modified capability throughout the rolling program. The curve for existing practice and 257 PIW was developed for a 4.25 inch slab reduced to a transfer bar of 0.596 inch in the roughing train. The modified capability curve utilizing my invention was developed for a 9 inch slab reduced to a transfer bar of 1.25 inches in the roughing train. In addition, since the rolling load and power required are appreciably lower, because of the higher temperature and resultant lower constrained yield stress, some "zoom" rolling can be employed to further improve the end-to-end thermomechanical properites of the product. Significantly, in the particular case studied, the increased specific coil weight in FIG. 2 was not limited by the rolling process, as is evident by the finish temperature profile, but only by the physical limitations of the furnaces, coilers, conveyors and other auxiliary equipment, external to the rolling mills.

Figure 3:
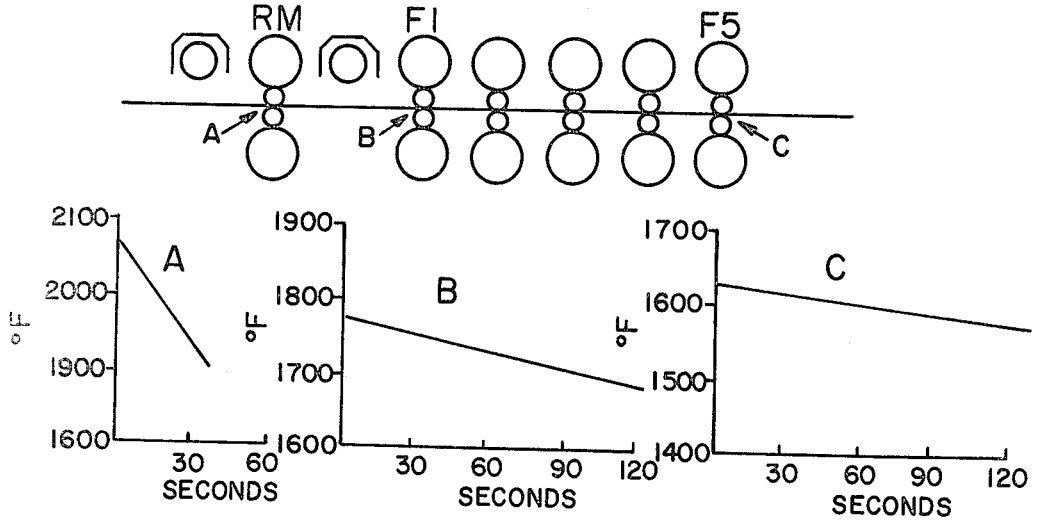
FIG. 3 is a schematic graphically showing temperature profiles of my rolling method designed to provide coils having 1,004 PIW.
Figure 4:
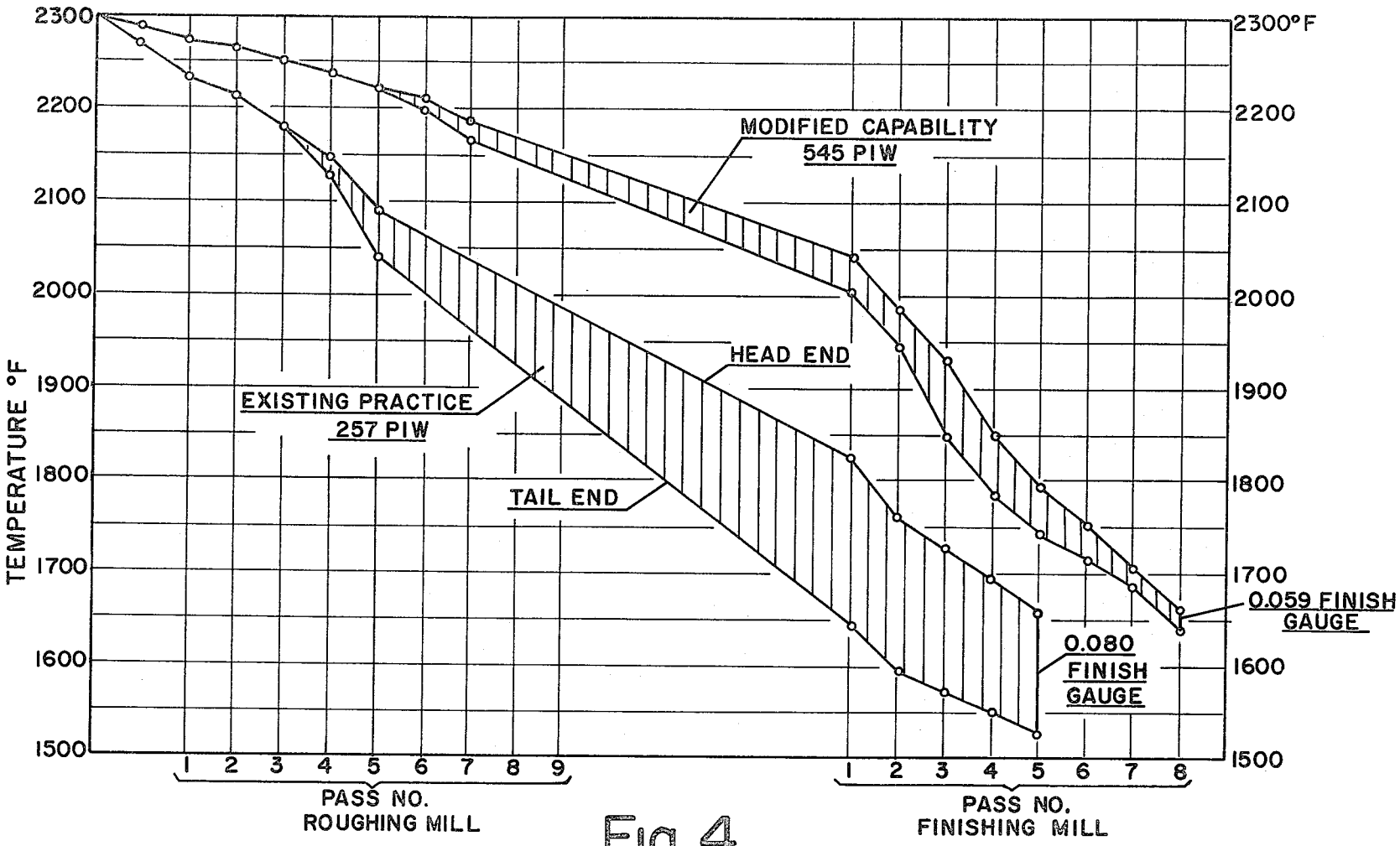
FIG. 4 is a graphic representation comparing existing practices with results obtained through the utilization of my rolling method.

The data for FIG. 2 was developed for the addition of the reversing finishing stand to an existing mill. That particular mill has a product capability limited by auxiliary equipment such as the existing slab furnace and capability of the downcoilers. By using my rolling method and projecting beyond the limitations of the existing auxiliary equipment in the FIG. 2 example, my invention can provide for the rolling of 1,004 PIW slabs to 0.059 inch finish gauge, as illustrated in FIG. 3. This improvement (shown in FIG. 3) in rolling capability of 1,000 PIW coils having only slight temperature differentials from head to tail represents a quantum jump of two generations in rolling mill technology.

Further, in those instances where it is not rational or economical to rebuild existing steel plants, since the manufacturing of steel involves many production units in series and the obsolescence of any unit can affect the viability of the total facility, or with new ventures, it is highly feasible to consider new steel plant facilities. The same basic concept that I employed in my invention. "Method for Modernizing A Hot Strip Mill", can be utilized in a new low cost hot strip mill. This concept is particularly well suited for the small steel producer, specialty steel plants, and especially the needs of developing countries. This new mill configuration can provide 1,000,000 to 1,250,000 tons per year of hot band production, at a lower investment cost than has been required by traditional facilities, and at the same time meet the needs of the marketplace.

Figure 5:
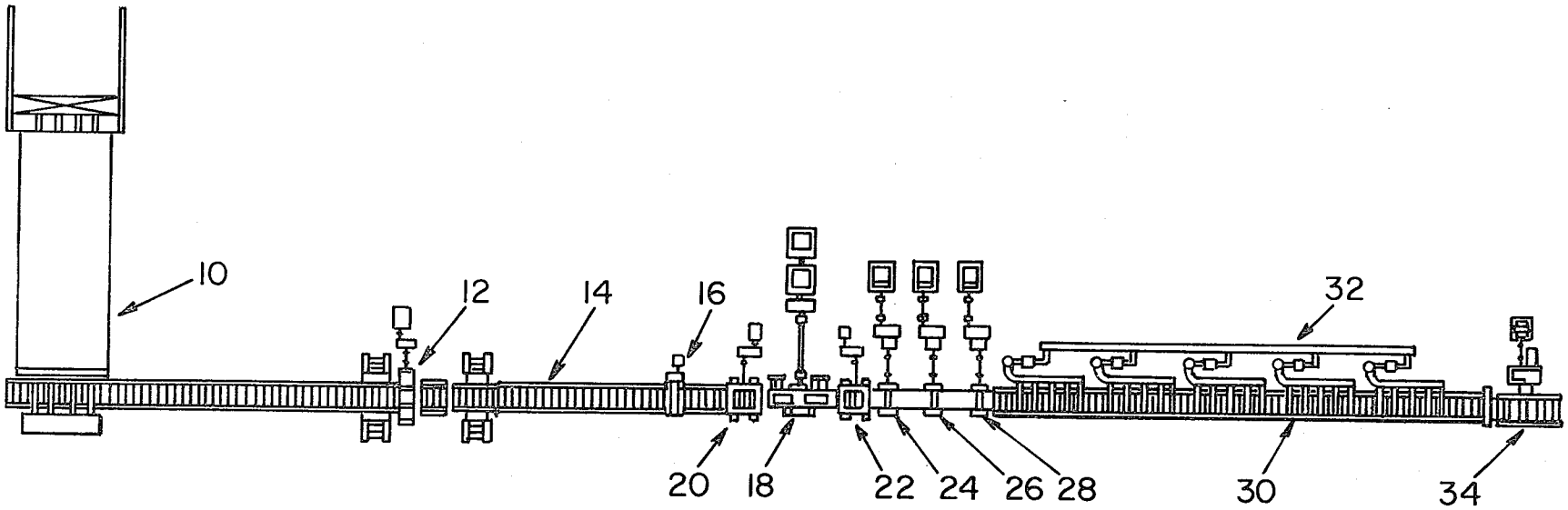
FIG. 5 is a new hot strip mill arrangement which will permit the carrying out of my rolling method.

This new hot strip mill is based on the same temperature conservation techniques that I employed in my aforementioned patent application. Such a mill is illustrated in FIG. 5. The mill consists of a walking beam slab heating furnace 10, a two-high or four-high reversing roughing mill 12 with vertical edger, a short runout table 14, a flying shear and descale box 16, a four-high reversing mill stand 18 with an upstream coiler furnace 20 and a downstream coiler furnace 22, three four-high finishing stands 24, 26 and 28, a runout table 30 having a cooling water equipment 32 and a coiler 34.

Slabs 9 inches to 12 inches thick up to 35 feet long are heated to rolling temperature in the furnace 10, delivered to the reversing roughing mill 12 and reduced in a number of passes to a transfer bar 1 to 3 inches thick. The distance between the reversing roughing mill 12 and the reversing finishing stand 18 is just slightly longer than the runout length of the transfer bar on the antepenultimate pass in the roughing mill 12 so that the bar is free of both the roughing mill 12 and the reversing finishing mill 18. This arrangement provides for the very minimum mill facility length. On the last pass, the transfer bar leaving the roughing mill 12 is from 1 to 3 inches thick and is run out at a high speed to enter into the reversing finishing mill 18 while the tail end is still in the roughing mill 12.

In this way, the transfer bar loses very little heat and the rundown in temperature from head to tail of the bar is minimal, as was the case with the reversing mill schematic of FIG. 2. On the third pass through the reversing mill 18, the speed of the strip is matched to the speed cone of the three continuous stands 22, 24 and 26 and delivered to the continuous stands in a similar manner as the reversing stand arrangement ahead of the existing finishing train. In this case, however, enough torque and mill separating force are designed into the facility to permit sufficient reduction in the three stands as compared with the five stands. This is practical because, with the concept of the reversing mill ahead of the continuous train, the steel is being rolled at much higher temperature and the resistance to deformation is significantly lower.

The reversing mill 18 is equipped with hydraulic automatic gauge control which adjusts the roll gap settings for all three passes, resulting in uniform end-to-end gauge when the bar enters and exits the three continuous stands.

The mass flow through the finishing stands of any given finishing train is a constant. As the workpiece is reduced in thickness, the speed of the workpiece increases and the speed cone or synchronization of the various finishing stands is based on this principle. By utilizing the reversing mill in the manner I do, I am able to provide mass flows far in excess of and totally independent of the finishing train during all passes through the reversing mill except the last pass. It is only in the last pass through the reversing mill that the mass flow need by synchronized with the speed cone of the finishing train. In so doing I have provided a rolling method in which temperature uniformity and product size can be achieved in more economical and feasible ways than known heretofore.

In addition, my studies of rolling programs for existing hot strip mills in order to implement my invention have revealed another significant side benefit. Because of the nature of the temperature loss of heated slabs and the temperature conservation characteristics of my invention, it would be possible to lower the drop-out temperature of the steel from the furnace, with no change in performance at the finishing mill. This procedure offers substantial energy saving benefits and higher furnace production since less fuel and less time per ton of steel are required by the reheat furnace to bring the slabs to rolling temperature.

I claim:

1. In the hot rolling of metal slabs to strip thickness on a hot strip mill including an in-line roughing train, a reversing mill stand having a coiling furnace on both an upstream side and a downstream side thereof and a finishing train having a synchronized speed cone associated therewith, the steps comprising:

A. passing a heated slab into and through the roughing mill to form a transfer bar;

B. passing said transfer bar back and forth through the reversing mill stand and in and out of said coiling furnaces in initial reducing passes to form a workpiece, said reversing mill stand being operated independent of said speed cone; and C. passing said workpiece from said upstream coiling furnace through said reversing mill stand in a final reducing pass and into the finishing train at a speed consonant with said speed cone.

2. The method of claim 1 wherein said initial reducing passes are carried out at speeds substantially greater than the final reducing pass.

3. In the hot rolling of metal slabs to strip thickness, the steps comprising:

A. passing a heated metal slab into and through a roughing mill and reducing the said slab to a transfer bar on the order of one to three inches in thickness;

B. passing said transfer bar immediately to and between the work rolls of a reversing finishing mill stand and reducing it in thickness;

C. passing the workpiece immediately into a heated furnace on the downstream side of said reversing finishing mill stand and coiling it in said furnace;

D. discharging the workpiece from said downstream heated furnace and passing it back through and further reducing the workpiece in said reversing finishing mill stand;

E. immediately passing the workpiece into and coiling it in the heated furnace on the upstream side of said mill stand;

F. thereafter uncoiling and discharging the workpiece from said upstream coiling furnace and passing it between the work rolls of said reversing finishing mill stand and further reducing it therein, the rolling speed on said pass being consonant with the speed cone on subsequent passes through continuous finishing stands and the rolling speeds on the two preceding passes on the reversing mill stand being higher than the speed on the third pass and unrelated to the aforesaid speed cone;

G. immediately thereafter passing said workpiece successively through and reducing it further in a plurality of continuous finishing stands; and H. thereafter cooling the strip and coiling it on a finish coiler.

4. The rolling method set forth in claim 3 and in which the initial slab weight passed to the roughing mill was sufficient to provide a finished coil having a specific weight on the order of 500 pounds per inch of width or more.

5. The rolling method defined in claim 3 and in which the slab initially fed to the roughing mill was on the order of nine to twelve inches in thickness and is reduced on the roughing mill to a thickness of on the order of one to three inches.

6. The rolling method as defined in claim 5 and in which the finished gauge of the strip is on the order of 0.050 inch to 0.080 inch and the specific weight of the coil is on the order of 500 pounds per inch of width or greater.

7. In the hot rolling of metal slabs to strip thickness and in coils having a specific weight on the order of 500 pounds per inch of width or greater, the steps comprising:

A. passing a heated metal slab into and through a roughing mill and reducing the slab to a transfer bar;

B. passing said transfer bar immediately to and between the work rolls of a reversing finishing mill stand and reducing it in thickness;

C. passing the workpiece immediately into a heated furnace on the downstream side of said reversing finishing mill stand and coiling it in said furnace;

D. discharging the workpiece from said downstream heated furnace and passing it back through and further reducing it in said reversing finishing mill stand;

E. immediately passing the workpiece into and coiling it in a heated furnace on the upstream side of said reversing mill stand;

F. thereafter uncoiling and discharging the workpiece from the upstream coiling furnace and passing it between the work rolls of said reversing finishing mill stand and further reducing it therein, the rolling speed on said third pass being consonant with the speed cone on subsequent passes through continuous finishing stands;

G. immediately thereafter passing the workpiece successively through and reducing it further in a plurality of continuous finishing stands; and H. thereafter cooling the formed strip and coiling it on a finish coiler.

8. In the rolling method defined in claim 7, maintaining the temperature profile of the workpiece entering the continuous stand such that between the front end thereof and the rear end the temperature differential is at all times less than 100°.

9. The rolling method of claim 7 and in which the temperature profile of the finished strip has a temperature drop of on the order of 100° or less from one end to the other.

* * * * *